US008919883B2

(12) United States Patent
Hankins et al.

(10) Patent No.: US 8,919,883 B2
(45) Date of Patent: Dec. 30, 2014

(54) CHAIR WITH FOLDABLE ARMREST AND ARMREST LOCKING MECHANISM

(75) Inventors: Danny Ray Hankins, Trinity, NC (US); Scott J. Williams, Green Bay, WI (US); Stephen Robert Hess, Green Bay, WI (US); Timothy G. Hornberger, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 256 days.

(21) Appl. No.: 13/472,730

(22) Filed: May 16, 2012

(65) Prior Publication Data

US 2013/0307308 A1 Nov. 21, 2013

(51) Int. Cl.
*A47C 7/54* (2006.01)

(52) U.S. Cl.
USPC ..... 297/411.34; 297/411.32

(58) Field of Classification Search
USPC ..... 297/411.38, 411.34, 411.32, 411.37; 5/427, 430
See application file for complete search history.

(56) References Cited

U.S. PATENT DOCUMENTS

| | | | | |
|---|---|---|---|---|
| 259,642 | A | 6/1882 | Hofstatter, Jr. | |
| 583,136 | A | 5/1897 | Anderson | |
| 1,336,062 | A * | 4/1920 | Arton | 5/52 |
| 1,357,740 | A * | 11/1920 | Stephan | 297/116 |
| 2,452,642 | A * | 11/1948 | Ewing | 297/116 |
| 2,790,485 | A | 4/1957 | Franklin | |
| 4,186,456 | A | 2/1980 | Huempfner | |
| 4,297,752 | A | 11/1981 | Dick et al. | |
| 4,858,260 | A | 8/1989 | Failor et al. | |
| 5,864,900 | A * | 2/1999 | Landau | 5/427 |
| 6,039,402 | A | 3/2000 | Nemoto | |
| 6,045,183 | A * | 4/2000 | Weber | 297/250.1 |
| 6,520,586 | B2 | 2/2003 | Park | |
| 6,637,812 | B2 | 10/2003 | Laughlin et al. | |
| 7,004,546 | B1 | 2/2006 | Thisius et al. | |
| 7,093,904 | B1 * | 8/2006 | McMillen | 297/411.37 |
| D572,490 | S | 7/2008 | Overthun et al. | |
| 7,644,991 | B2 | 1/2010 | Davis et al. | |

* cited by examiner

*Primary Examiner* — David R Dunn
*Assistant Examiner* — Tania Abraham
(74) *Attorney, Agent, or Firm* — Andrus Intellectual Property Law, LLP

(57) ABSTRACT

A chair that facilitates user ingress and egress has a chair support structure and a seat, a backrest, and at least one armrest coupled to the chair support structure. A lower portion of the armrest is coupled to the chair support structure and an upper portion of the armrest is coupled to the lower portion to allow rotation of the upper portion with respect to the lower portion around a horizontal axis that splits the armrest into the two portions. The upper portion can be placed in an upright position above the lower portion and a folded position alongside the lower portion by rotation of the upper portion around the horizontal axis. The upper portion can be locked in the upright position with a locking mechanism that can extend through both the lower portion and the upper portion to prevent rotation of the upper portion around the horizontal axis.

12 Claims, 7 Drawing Sheets

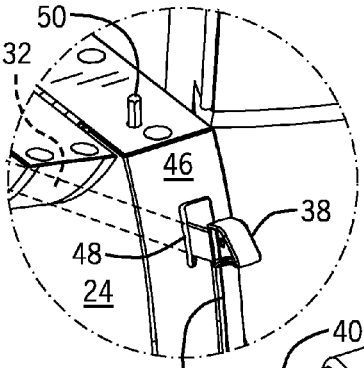
FIG. 4
FIG. 3
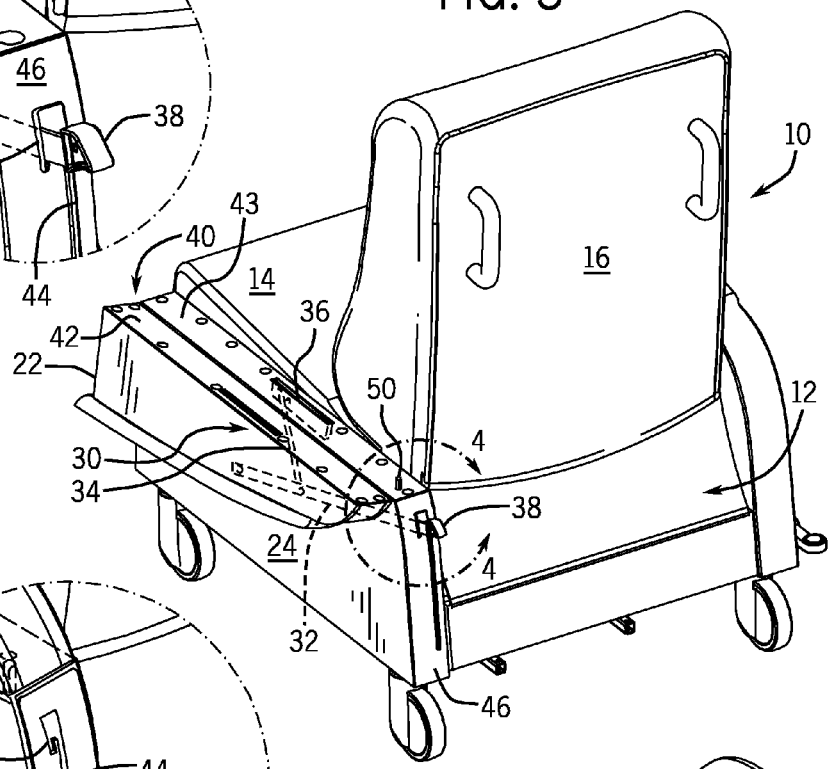
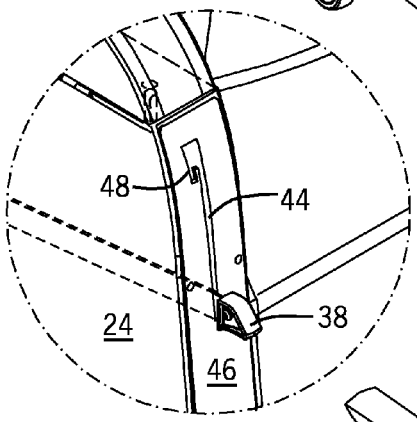
FIG. 6
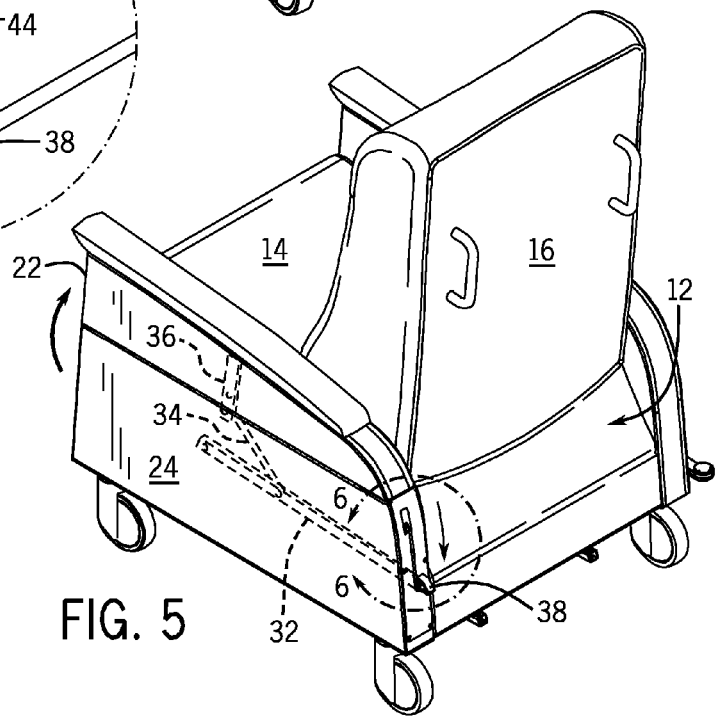
FIG. 5

CHAIR WITH FOLDABLE ARMREST AND ARMREST LOCKING MECHANISM

BACKGROUND

The present disclosure relates to chairs for patients having limited mobility. More specifically, the present disclosure relates to arm chairs that allow for easy ingress and egress of a patient.

Special considerations are needed when designing chairs for patients having limited mobility. Sometimes, such chairs have wheels so that the patient can be transported from one place to another. Such chairs are sometimes also capable of reclining to provide comfort to the patient. Oftentimes, such chairs will have armrests on either side of the chair to keep the patient seated safely on the chair and to provide a surface upon which the patient may rest his or her arm while the patient, for example, has blood drawn or an IV inserted.

When a patient has limited mobility, it is difficult to move the patient onto and off of the chair if the chair has armrests. Therefore, it is desirable to provide a chair having at least one moveable armrest that allows the patient to move laterally onto and off of the side of the chair, which is easier for the patient than moving onto and off of the front of the chair.

In some such chairs having moveable armrests, the armrest is capable of swinging about a vertical axis to allow ingress and egress laterally to and from the side of the chair. Other chairs provide for telescoping of an upper part of the armrest into a recessed area in a lower part of the armrest. Other chairs have an armrest that can be removed completely from the side of the chair.

SUMMARY

A chair that facilitates user ingress and egress is disclosed. The chair comprises a chair support structure, a seat coupled to the chair support structure in a generally horizontal orientation, and a backrest coupled to the chair support structure in a generally vertical orientation. At least one armrest is coupled to the chair support structure in a generally vertical orientation. The armrest comprises an upper portion and a lower portion. The lower portion is coupled to the chair support structure and the upper portion is coupled to the lower portion in a manner that allows rotation of the upper portion with respect to the lower portion around a horizontal axis that splits the armrest into the upper and lower portions. The upper portion can be placed in an upright position above the lower portion and can be placed into a folded position alongside the lower portion by rotation of the upper portion around the horizontal axis. The upper portion can also be locked in the upright position with a locking mechanism that can extend through both the lower portion and the upper portion to thereby prevent rotation of the upper portion around the horizontal axis.

In another embodiment of the present disclosure, a foldable chair arm is disclosed. The foldable chair arm comprises an upper portion and a lower portion, the upper and lower portions being coupled to each other in a manner that allows the upper portion to be swung down from an upright position to a folded position alongside the lower portion. The chair arm further comprises a locking mechanism that extends from the lower portion into the upper portion when the upper portion is in the upright position and is locked, the locking mechanism thereby preventing swinging of the upper portion into the folded position. The chair arm further comprises a locking mechanism actuator that allows the locking mechanism to be put into the locked position or into an unlocked position, wherein the locking mechanism does not extend into the upper portion.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings:

FIG. 3 depicts a back view of the embodiment of FIG. 2 with the armrest in the folded position;

FIG. 4 depicts a detailed view of a first embodiment of a locking mechanism actuator;

FIG. 5 depicts the armrest of FIGS. 2-4 in an upright position;

FIG. 6 depicts a detailed view of the locking mechanism actuator when the armrest is in the upright position of FIG. 5;

DETAILED DESCRIPTION OF THE DRAWINGS

In the present description, certain terms have been used for brevity, clearness and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives, and modifications are possible within the scope of the appended claims. Each limitation in the appended claims is intended to invoke interpretation under 35 USC §112, sixth paragraph, only if the terms "means for" or "step for" are explicitly recited in the respective limitation.

Figure 1:
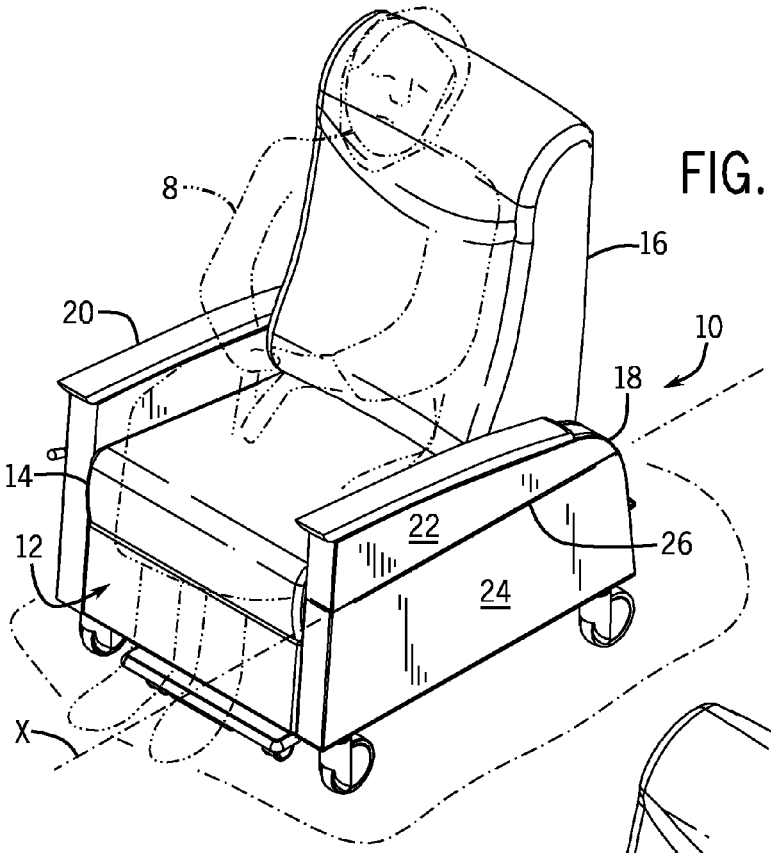
FIG. 1 depicts a chair according to the present disclosure with a user seated therein.

FIG. 1 depicts a chair 10 with a user 8 seated therein. The chair comprises a chair support structure 12, a seat 14 coupled to the chair support structure 12 in a generally horizontal orientation, a backrest 16 coupled to the chair support structure in a generally vertical orientation, and at least one armrest 18 coupled to the chair support structure 12 in a generally vertical orientation. The chair 10 includes a second armrest 20, which in this example is a non-foldable armrest. However, in other embodiments, both of the armrests 18, 20 can be foldable. The foldable armrest 18 comprises an upper portion 22 and a lower portion 24. The lower portion 24 is fixed to the chair support structure 12. The upper portion 22 is attached to the lower portion 24 along a horizontal pivot axis x. The horizontal pivot axis x splits the armrest 18 into the upper 22 and lower 24 portions. The upper portion 22 is coupled to the lower portion 24 in a manner that allows rotation of the upper portion 22 with respect to the lower portion 24 around the horizontal pivot axis x. For example, such rotation can be allowed by incorporation of a hinge 26 between the upper portion 22 and the lower portion 24.

Figure 2:
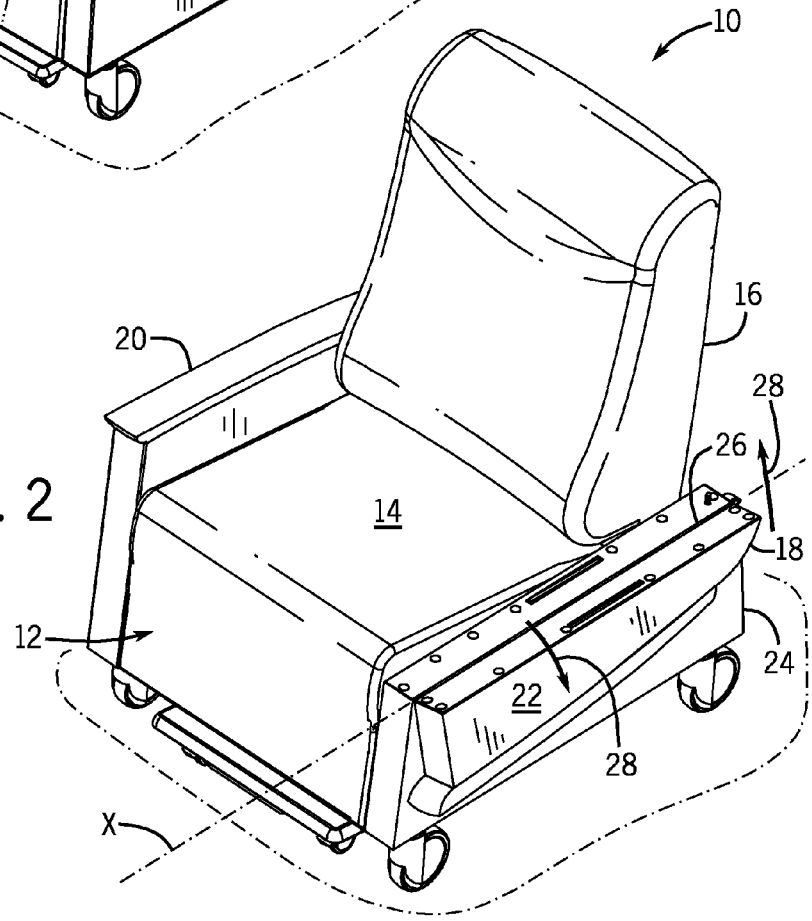
FIG. 2 depicts a front view of a chair with a first embodiment of an armrest in a folded position.
Figure 7:
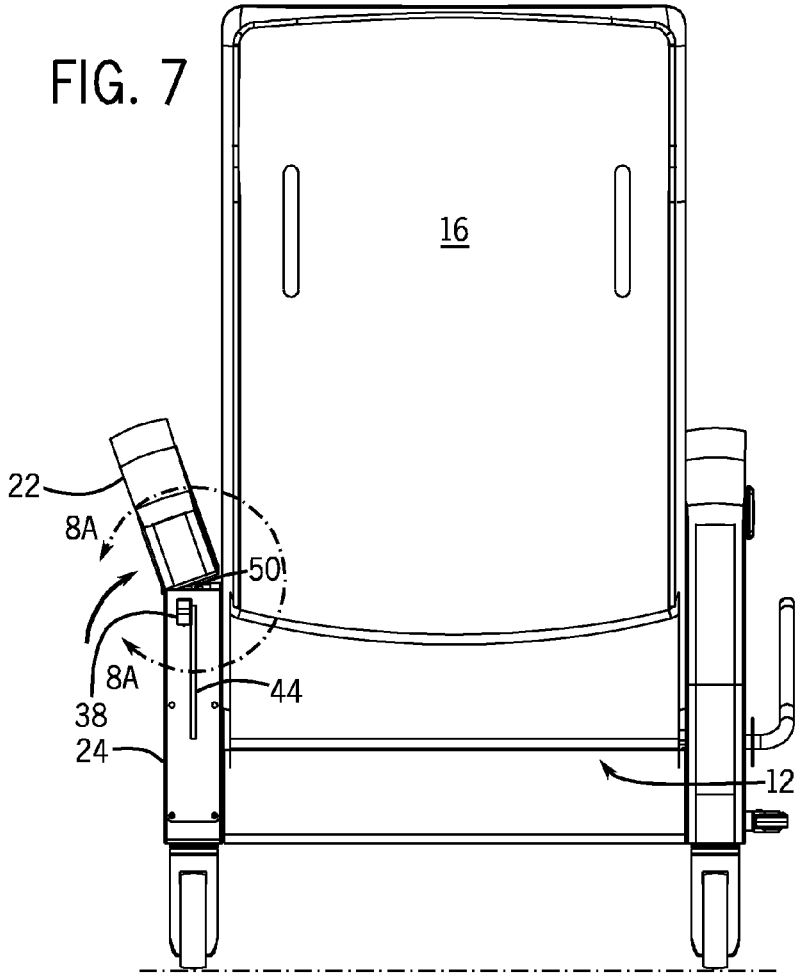
FIG. 7 depicts the chair with the armrest in a partially upright, unlocked position.

The upper portion 22 can be placed in an upright position, as shown in FIG. 1, above the lower portion 24. The upper portion 22 can also be moved into a folded position, as shown in FIG. 2, alongside the lower portion 24 by rotation of the upper portion 22 around the horizontal pivot axis x at the hinge 26. Such rotation is shown by arrows 28 in FIG. 2.

FIG. 3 depicts a locking mechanism 30 that forms part of the armrest 18. In the example shown, the locking mechanism 30 comprises three separate parts: a lever arm 32, an intermediate arm 34, and a locking arm 36. The locking mechanism 30 can further comprise a locking mechanism actuator 38. The locking mechanism actuator 38 allows a user to move the locking mechanism 30 from a locked position, shown in FIG. 5, wherein the locking arm 36 of the locking mechanism 30 extends from the lower portion 24 into the upper portion 22, to an unlocked position, shown in FIG. 3, wherein the locking arm 36 of the locking mechanism 30 does not extend into the upper portion 22.

As shown in FIG. 3, when the upper portion 22 is folded down alongside the lower portion 24, a generally horizontal plane 40 is created by the adjacent exposed face 42 of the upper portion 22 and the exposed face 43 of the and lower portion 24. This horizontal plane 40 is generally level with the seat 14, and thereby facilitates user ingress and egress to and from the side of the chair 10.

One embodiment of the locking mechanism actuator 38 is shown in detail in FIG. 4. The locking mechanism actuator 38 is attached to one end of the lever arm 32 of the locking mechanism 30. The locking mechanism actuator 38 extends through a slot 44 provided on a rear face 46 of the lower portion 24 of the armrest 18. The locking mechanism actuator 38 is connected to the lever arm 32 through the slot 44. The locking mechanism actuator 38 can be moved from an upper end of the slot 44, as shown in FIGS. 3 and 4, to a lower end of the slot 44, as shown in FIGS. 5 and 6. The upper end of the slot 44 is provided with an offset holding slot 48 that allows the lever arm 32 to be held near the upper end of the slot 44, as shown in FIGS. 3 and 4, until it is moved out of the offset holding slot 48 and slid down through the slot 44.

The armrest 18 is also provided with a safety catch, such as for example a spring-loaded tab 50, shown in FIGS. 3 and 4. The tab 50 extends into the horizontal plane 40 created by the exposed faces 42, 43 of the upper 22 and lower 24 portions of the armrest 18. Preferably, the tab 50 is spring loaded such that the upper portion 22 of the armrest 18 must be forcefully pushed down against the lower portion 24 of the armrest 18, as shown in FIG. 8*b*, to oppose the bias of the spring loaded tab 50. Such force is shown applied by arrow 52 in FIG. 8*b*. When the force, as shown at arrow 52, is sufficient to overcome the bias of the spring loaded tab 50, the upper portion 22 is generally vertical and the locking mechanism actuator 38 can be displaced from the offset holding slot 48 and placed in line with slot 44, as shown by arrow 54 in FIG. 8*b*. Once such displacement, as shown by arrow 54, has taken place, the locking mechanism actuator 38 can be moved to the lower end of the slot 44, thereby moving the lever arm 32. The spring loaded tab 50 ensures that sufficient force, as shown at arrow 52, must be continuously applied to the upper portion 22 of the armrest 18 to position the upper portion 22 in its fully upright position, as shown in FIGS. 1, 5, and 6. Thus, the upper portion 22 cannot simply rest in the upright position without being safely locked in this position. The tab 50 ensures that the locking mechanism actuator 38 must be moved to the bottom end of the slot 44 to thereby lock the upper portion 22 in such an upright position with the locking mechanism 30.

Figure 9:
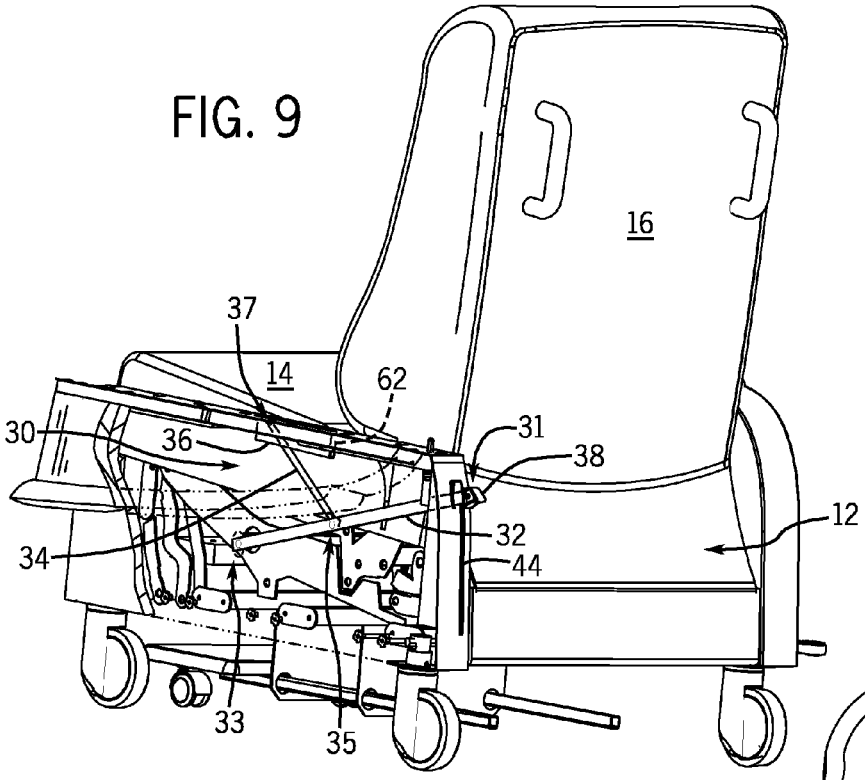
FIG. 9 depicts a partial cutaway view of the armrest of FIGS. 2-8 in the folded position.
Figure 10:
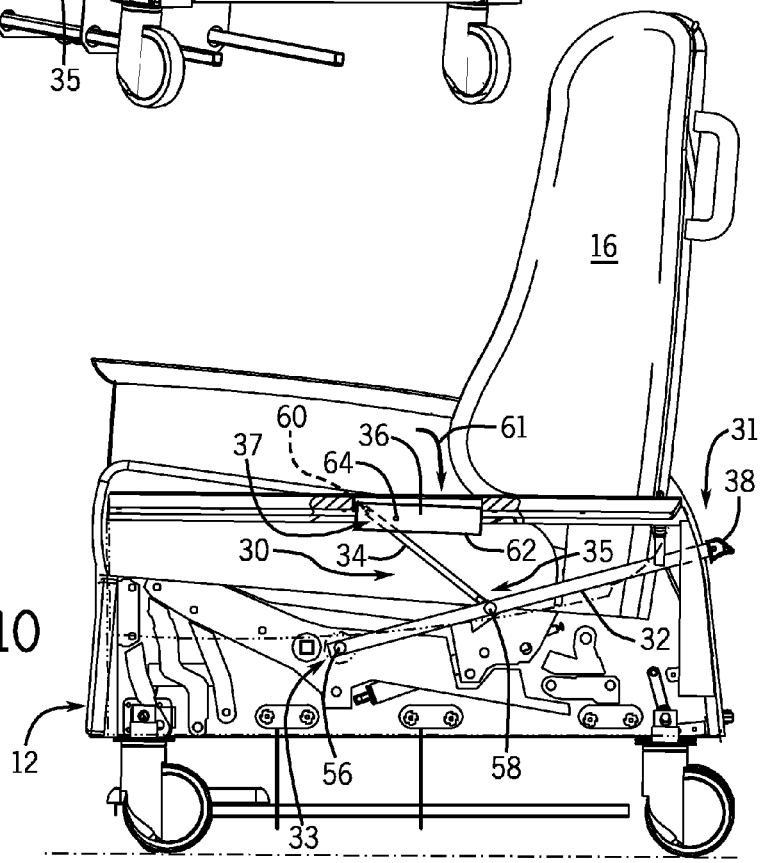
FIG. 10 depicts an alternate cutaway view of the armrest in the folded position.

With reference to FIGS. 9 and 10, operation of the locking mechanism 30 will be described in more detail. The locking mechanism 30, as described above, comprises a lever arm 32, an intermediate arm 34, and a locking arm 36. A first end 31 of the lever arm 32 is fitted with the locking mechanism actuator 38. A second end 33 of the lever arm 32 comprises a fixed pivot 56, which is fixed to the chair support structure 12 by, for example, a dowel, a nut and bolt combination, or the like. Between the first 31 and second 33 ends of the lever arm 32, there is a movable pivot 58. This movable pivot 58 is not fixed to the chair support structure 12. Rather, the movable pivot 58 is rotatably fixed to a first end 35 of the intermediate arm 34. A second end 37 of the intermediate arm 34 also comprises a moveable pivot 60. The intermediate arm 34 is rotatably fixed to an end of the locking arm 36 at the movable pivot 60. The locking arm 36 extends from a pivot end 61 (FIG. 11) that is movably rotatably fixed to the intermediate arm 34 at movable pivot 60 to a free end 62. Between the pivot end 61 that is coupled to the intermediate arm 34 and the free end 62, the locking arm 36 comprises a fixed pivot 64, which is fixed to the chair support structure 12 by means of a dowel, a nut and bolt combination, or the like.

In FIGS. 9 and 10, the locking mechanism actuator 38 has been moved to the upper end of the slot 44. This causes the lever arm 32 to rotate at the fixed pivot 56 and to push the intermediate arm 34 in a generally upward direction via the movable pivot 58 between the lever arm 32 and the intermediate arm 34. Movement of the intermediate arm 34 in the downward direction in turn causes movement of the locking arm 36 at the movable pivot 60, thereby causing the locking arm 36 to rotate in a clockwise direction as shown by arrow 61 around the fixed pivot 64 such that its free end 62 is retracted into the lower portion 24 of the armrest 18.

Figure 8A:
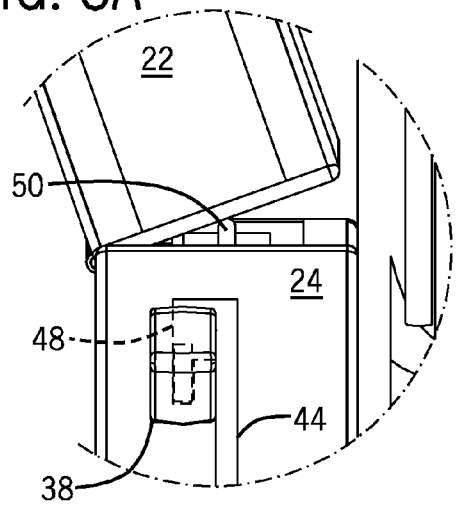
FIGS. 8A and 8B depict a safety catch located in the chair arm of FIGS. 2-7.
Figure 8B:
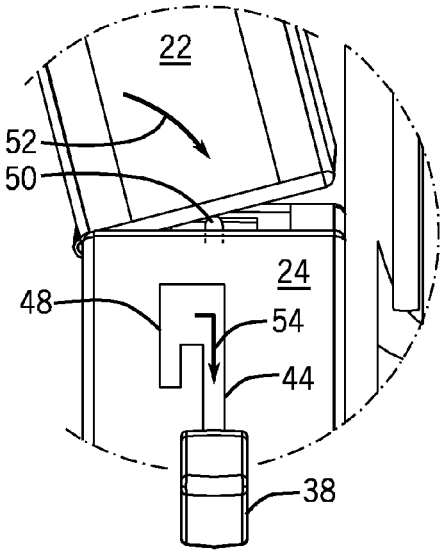
Figure 11:
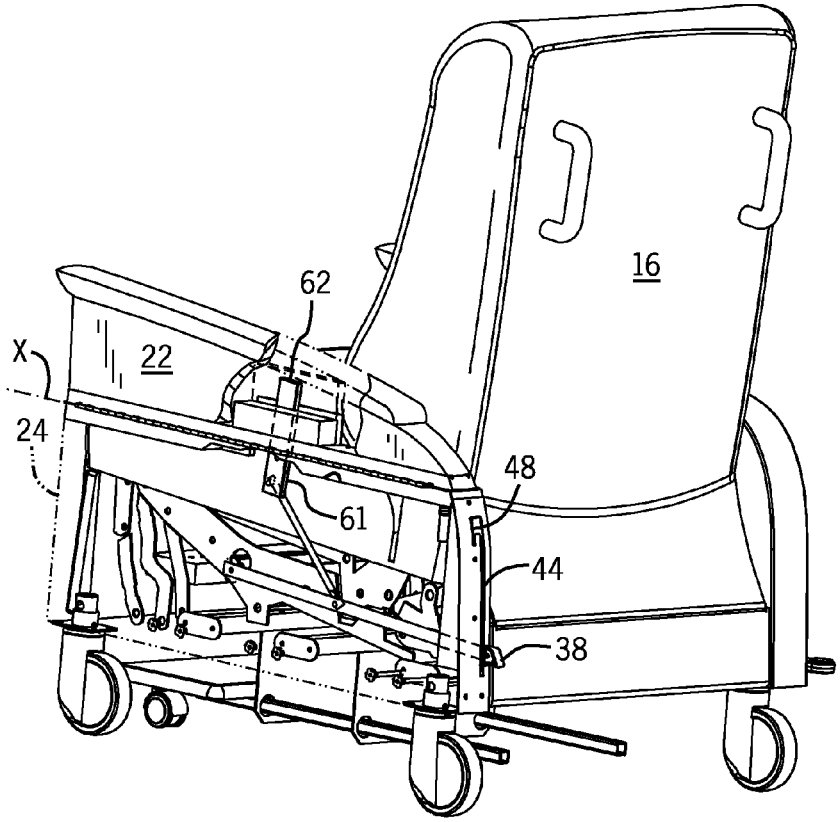
FIG. 11 depicts a partial cutaway view of the armrest in the upright position.
Figure 12:
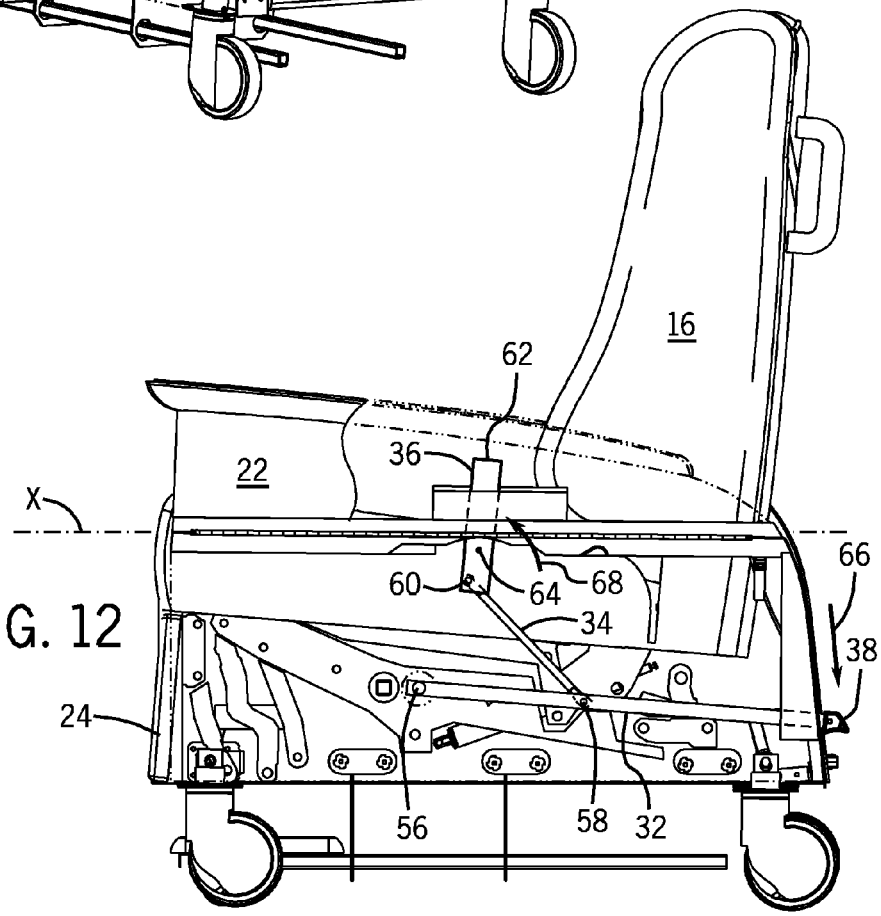
FIG. 12 depicts an alternate partial cutaway view of the armrest in the upright position.

As shown in FIGS. 11 and 12, and with reference to FIGS. 8*a* and 8*b*, once the locking mechanism actuator 38 has been removed from the offset holding slot 48 and is capable of movement within the slot 44, and once the tab 50 has been biased by application of force as shown at arrow 52 in FIG. 8*b*, the upper portion 22 of the armrest 18 can be locked in the fully upright position. Locking the armrest 18 in the fully upright position requires applying a downward force to the locking mechanism actuator 38 as shown by arrow 66 in FIG. 12. Pushing the locking mechanism actuator 38 in the downward direction as shown by arrow 66 causes the lever arm 32 to pivot around the fixed pivot 56 and to pull the intermediate arm 34 in a downward direction due to the connection between the lever arm 32 and the intermediate arm 34 at the movable pivot 58. Movement of the intermediate arm 34 in the downward direction causes movement of the locking arm 36 at the movable pivot 60 and thereby causes the locking arm 36 to rotate in a counterclockwise direction around the fixed pivot at 64 as shown by arrow 68. This causes the free end 62 of the locking arm 36 to extend into the upper portion 22 of the armrest 18. Extension of the free end 62 into the upper portion 22 prevents rotation of the upper portion 22 around the horizontal axis x and thereby prevents folding of the armrest 18.

Figure 13:
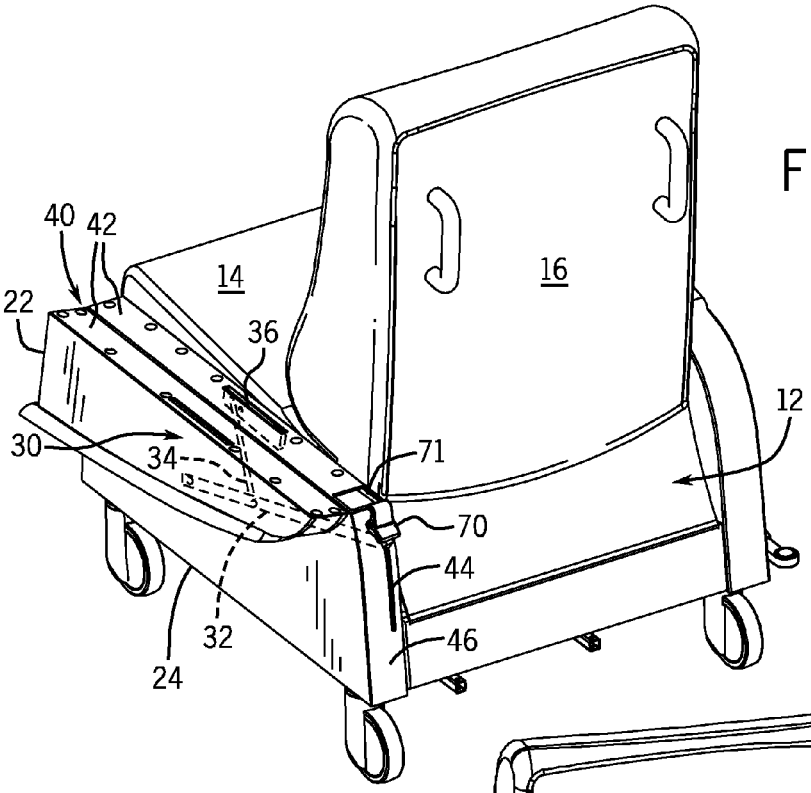
FIG. 13 depicts a chair with a second embodiment of the armrest in a folded position.
Figure 14:
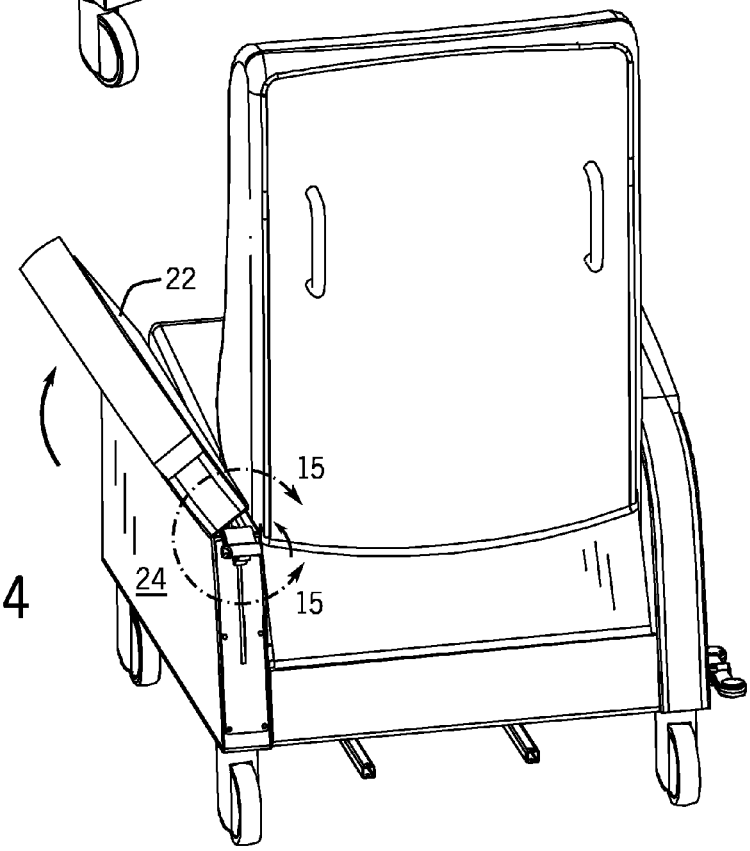
FIG. 14 depicts the embodiment of FIG. 13 when the armrest is in a partially upright, unlocked position.

Now with reference to FIGS. 13-18, an alternative embodiment of the armrest 18 and the safety catch will be described. In this embodiment, as shown in FIG. 13, the locking mechanism actuator comprises a paddle 70 that extends through the slot 44 in the rear face 46 of the lower portion 24 of the armrest 18 to connect to the lever arm 32 of the locking mechanism 30 in the same way as shown in FIGS. 1-12. The workings of the locking mechanism 30 are the same as those of the embodiment of FIGS. 1-12. In other words, as shown in FIG. 13, when the paddle 70 is at the upper end of the slot 44, the lever arm 32 via its connection to the locking arm 36 by the intermediate arm 34 places the locking mechanism 30 in an unlocked position. Similarly, as shown in FIG. 18, when the paddle 70 is at the bottom end of the slot 44, the lever arm 32 via its connection to the locking arm 36 by the intermediate arm 34 causes the locking arm 36 to extend into the upper portion 22 of the armrest 18, thereby locking the armrest 18 in the upright position.

More specifically, in both embodiments, the locking mechanism 30 comprises a locking arm 36 having a fixed pivot 64 around which the locking arm 36 rotates such that one end of the locking arm 36 can extend into the upper portion 22 of the armrest 18 and the other end of the locking arm 18 can extend into the lower portion 24 of the armrest 18. The locking mechanism 30 further comprises a lever arm 32 and an intermediate arm 34, the intermediate arm 34 having movable pivots at first 35 and second 37 ends, wherein the first end 35 is coupled via a movable pivot 58 to the lever arm 32 and the second end 37 is coupled via a movable pivot 60 to one end of the locking arm 36. The end of the locking arm 36 that is not coupled to the second end 37 of the intermediate arm 34 is a free end 62. The locking arm fixed pivot 64 is located at a point along the locking arm 36 that is between the free end 62 and the end that is coupled to the intermediate arm 34. The locking arm fixed pivot 64 is fixed with respect to the chair support structure 12. A first end 31 of the lever arm 32 comprises a locking mechanism actuator 38, 70 that allows a user to move the locking arm 32 via the movable pivot 58 between the lever arm 32 and the intermediate arm 34 and via the movable pivot 60 between the intermediate arm 34 and the locking arm 36. A second end 33 of the lever arm 32 comprises a fixed pivot 56, and the movable pivot 58 between the lever arm 32 and the first end 35 of the intermediate arm 34 is located along the length of the lever arm 32 between the first 31 and second 33 ends. The lever arm fixed pivot 56 is fixed with respect to the chair support structure 12.

The lever arm 32, intermediate arm 34, and locking arm fixed pivot 64 are located adjacent the lower portion 24 of the armrest 18, such that the locking arm 36 can be rotated from an unlocked position in which both of its ends are located adjacent the lower portion 24 to a locked position in which the free end 62 extends adjacent the upper portion 22. Pushing the locking mechanism actuator 38, 70 in a downward direction causes the lever arm 32 to rotate at the lever arm fixed pivot 56, thereby pulling the first end 35 of the intermediate arm 34 that is coupled to the lever arm 32 in a downward direction, thereby pulling the end of the locking arm 36 that is coupled to the intermediate arm 34, thereby causing the locking arm 36 to rotate about the locking arm fixed pivot 64, thereby rotating the free end 62 of the locking arm 36 into the upper portion 22 of the armrest 18. Pushing the locking mechanism actuator 38, 70 in an upward direction causes the free end 62 of the locking arm 36 to be retracted from the upper portion 22 of the armrest 18.

Figure 15:
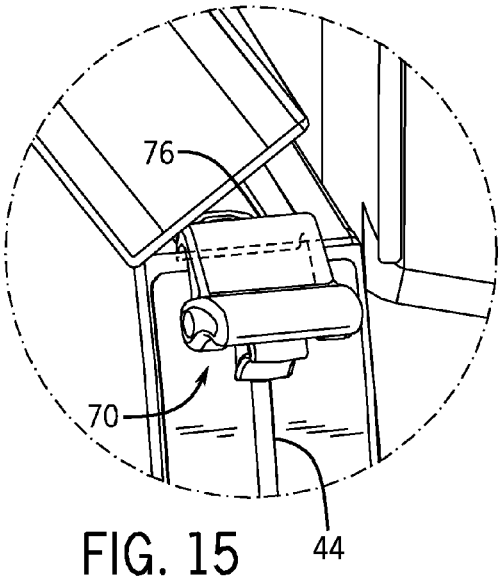
FIG. 15 depicts a detailed view of a second embodiment of the locking mechanism actuator.
Figure 16:
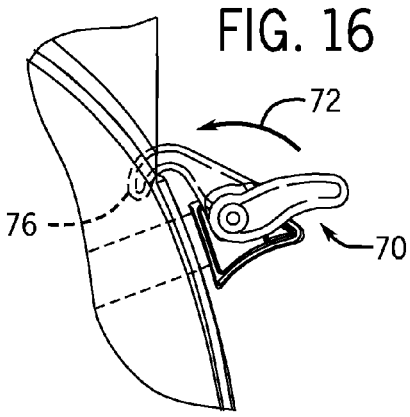
FIGS. 16 and 17 depict different positions of the second embodiment of the locking mechanism actuator with respect to the armrest.
Figure 17:
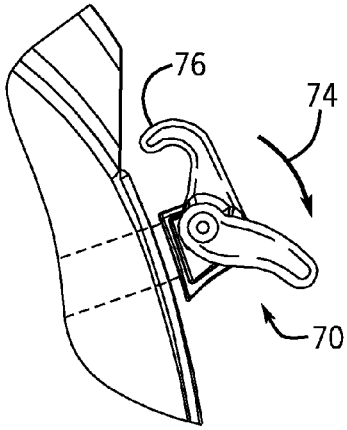
Figure 18:
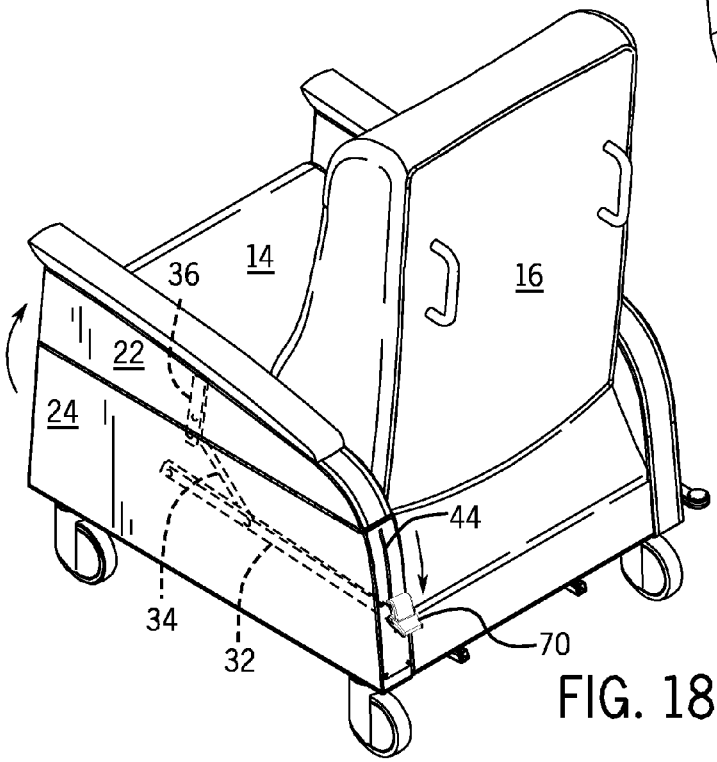
FIG. 18 depicts the second embodiment of the armrest in an upright position.

One difference between the embodiment of FIGS. 13-18 and the embodiment of FIGS. 1-12 is that the paddle 70 shown in FIGS. 13-18 performs the function of both the spring-loaded tab 50 and the locking mechanism actuator 38 shown in FIGS. 1-12. For example, as shown in FIG. 16, the paddle 70 is spring biased such that when the paddle 70 is at the upper end of the slot 44, one end 76 of the paddle 70 is biased as shown by arrow 72 onto the horizontal plane 40 created by the exposed faces 42 of the upper 22 and lower 24 portions. The armrest 18 may optionally be provided with a recess 71 in which the end 76 of the paddle 70 may rest. The bias of the paddle 70 as shown by arrow 72 necessitates a user-applied reverse bias, as shown by arrow 74 in FIG. 17, to remove the end 76 of the paddle 70 from the horizontal plane 40 (or from the optional recess 71). It is only when the end 76 of the paddle 70 has been removed from this horizontal plane 40 that the upper portion 22 of the armrest 18 can be situated in a fully upright position above the lower portion 24. When the paddle 70 is biased onto the horizontal plane 40, its end 76 prevents the upper portion 22 from returning to a fully upright position, as shown in FIG. 15. Thus, the paddle 70 provides both a connection to the lever arm 32 for moving the locking mechanism 30 into and out of a locked position, and a spring biased safety catch for preventing the upper portion 22 of the armrest 18 from returning to a fully upright position without a user first purposefully applying force to the paddle 70 as shown by arrow 74 in FIG. 17. Such application of force to the paddle 70 actuates the locking mechanism 30 and places it in the locked position, as shown in FIG. 18.

Therefore, a safety catch must be actuated in order to lock the upper portion 22 in the upright position. As shown in FIGS. 3, 4, 8A, and 8B, the safety catch can be a spring-loaded tab 50 that is biased such that one end extends above the horizontal plane 40 and prevents the upper portion 22 from returning to its upright position unless the user forcibly opposes the bias of the tab 50. Or, as shown in FIGS. 15-17, the safety catch can be a paddle 70, one end 76 of which obstructs the upper portion 22 from returning to its upright position by placement of that end 76 on the horizontal plane 40. The paddle 70 is spring-loaded such that the one end 76 is biased onto the horizontal plane 40.

Through the provision of an armrest 18 that can fold down and a locking mechanism 30 with a spring-loaded tab 50 (or a paddle 70) the present disclosure provides a way for a user to ensure that the upper portion 22 of the armrest 18 is in a fully upright and locked position above the lower portion 24 so that a user is not harmed by insufficient locking or only apparent locking of the upper portion 22 of the arm in the upright position.

We claim:

1. A chair that facilitates user ingress and egress, the chair comprising:

a chair support structure;

a seat coupled to the chair support structure in a generally horizontal orientation;

a backrest coupled to the chair support structure in a generally vertical orientation; and at least one armrest coupled to the chair support structure in a generally vertical orientation;

wherein the armrest comprises an upper portion and a lower portion, the lower portion being coupled to the chair support structure and the upper portion being coupled to the lower portion, wherein the upper portion is movable relative to the lower portion about a horizontal pivot axis that splits the armrest into the upper and lower portions;

wherein the upper portion can be placed in an upright position above the lower portion a id a folded position alongside the lower portion by movement of the upper portion around the horizontal pivot axis;

wherein the upper portion can be locked in the upright position by a locking mechanism that extends through both the lower portion and the upper portion to prevent movement of the upper portion about the horizontal pivot axis, the locking mechanism comprising a rotatable locking arm, a lever arm and an intermediate arm having movable pivots at first and second ends; and wherein one end of the locking arm extends into the upper portion of the armrest in the locked position and the first end of the intermediate arm is coupled via a first movable pivot to the lever arm and the second end is coupled via a second movable pivot to one end of the locking arm.

2. The chair of claim 1, wherein the locking mechanism further comprises a locking mechanism actuator that allows a user to move the locking mechanism from a locked position, wherein the locking mechanism extends into the upper portion, to an unlocked position, wherein the locking mechanism does not extend into the upper portion.

3. The chair of claim 1, wherein the locking arm includes a free end and an opposite pivot end coupled to the second end of the intermediate arm.

4. The chair of claim 3, wherein the locking arm fixed pivot is located at a point along the locking arm that is between the free end and the pivot end.

5. The chair of claim 4, wherein the locking arm fixed pivot is fixed with respect to the chair support structure.

6. The chair of claim 3, wherein a first end of the lever arm comprises a locking mechanism actuator that allows a user to move the locking arm via the movable pivot between the lever arm and the intermediate arm and via the movable pivot between the intermediate arm and the locking arm.

7. The chair of claim 6, wherein a second end of the lever arm comprises a fixed pivot, and wherein the movable pivot between the lever arm the first end of the intermediate arm is located along the length of the lever arm between the first and second ends.

8. The chair of claim 7, wherein the lever arm fixed pivot is fixed with respect to the chair support structure.

9. The chair of claim 7, wherein the lever arm, intermediate arm, and locking arm fixed pivot are located adjacent the lower portion of the armrest, such that the locking arm can be rotated from an unlocked position in which both of its ends are located adjacent the lower portion to a locked position in which the free end extends into the upper portion.

10. A chair that facilitates user ingress and egress, the chair comprising:

a chair support structure;

a seat coupled to the chair support structure in a generally horizontal orientation;

a backrest coupled to the chair support structure in a generally vertical orientation; and at least one armrest coupled to the chair support structure in a generally vertical orientation;

wherein the armrest comprises an upper portion and a lower portion, the lower portion being coupled to the chair support structure and the upper portion being coupled to the lower portion, wherein the upper portion is movable relative to the lower portion about a horizontal pivot axis that splits the armrest into the upper and lower portions;

wherein the upper portion can be placed in an upright position above the lower portion and a folded position alongside the lower portion by movement of the upper portion around the horizontal pivot axis;

wherein the upper portion can be locked in the upright position by a locking mechanism that extends through both the lower portion and the upper portion to prevent movement of the upper portion about the horizontal pivot axis; and a safety catch that must be actuated to lock the upper portion in the upright position, the safety catch including a paddle, one end of which obstructs the upper portion from returning to its upright position by placement of that end on the horizontal plane.

11. The chair of claim 10, wherein the paddle is spring-loaded such that the one end is biased onto the horizontal plane.

12. The chair of claim 10, wherein the safety catch comprises a spring-loaded tab that is biased such that one end extends above the horizontal plane and prevents the upper portion from returning to its upright position unless the user forcibly opposes the bias of the tab.

* * * * *

UNITED STATES PATENT AND TRADEMARK OFFICE

CERTIFICATE OF CORRECTION

PATENT NO. : 8,919,883 B2
APPLICATION NO. : 13/472730
DATED : December 30, 2014
INVENTOR(S) : Danny Ray Hankins et al.

It is certified that error appears in the above-identified patent and that said Letters Patent is hereby corrected as shown below:

IN THE CLAIMS:

In claim 1, column 7, line 2, after the word "portion" delete "a id" and substitute therefore --and--.

Signed and Sealed this
Nineteenth Day of May, 2015

Michelle K. Lee

Michelle K. Lee
*Director of the United States Patent and Trademark Office*